US005669253A

United States Patent [19]

Higgins

[11] Patent Number: 5,669,253

[45] Date of Patent: Sep. 23, 1997

[54] LOCKING STRAP

[76] Inventor: Scott W. Higgins, 26 Central St., Northfield, Vt. 05663

[21] Appl. No.: 670,265

[22] Filed: Jun. 21, 1996

[51] Int. Cl.[6] ..... E05B 73/00

[52] U.S. Cl. ..... 70/18; 70/14; 70/233; 70/312

[58] Field of Search ..... 24/166, 170; 70/312, 70/14, 18, 67, 69–76, 233

[56] References Cited

U.S. PATENT DOCUMENTS

| | | | |
|---|---|---|---|
| 693,079 | 2/1902 | Stoneman | 24/167 |
| 700,158 | 5/1902 | Stoneman | 24/167 |
| 2,512,028 | 6/1950 | MacMillan | 70/312 |
| 2,637,194 | 5/1953 | Pietri | 70/312 |
| 2,664,738 | 1/1954 | Paganini | 70/312 |
| 2,826,796 | 3/1958 | Davis | 24/170 |
| 3,042,986 | 7/1962 | Racette et al. | 24/170 |
| 3,053,071 | 9/1962 | Badoud | 70/312 |
| 3,252,193 | 5/1966 | Mathews et al. | 24/170 |
| 3,608,158 | 9/1971 | Bengtsson | 24/170 |
| 3,852,855 | 12/1974 | Bengtsson | 24/170 |
| 3,875,771 | 4/1975 | Reisner | 70/18 |
| 4,198,837 | 4/1980 | Gisiger | 70/312 |
| 4,261,493 | 4/1981 | Newman | 70/18 |
| 4,604,772 | 8/1986 | Arff | 240/170 |
| 4,685,315 | 8/1987 | Comolli | 24/170 |
| 4,726,625 | 2/1988 | Bougher | 24/170 |
| 4,891,866 | 1/1990 | Kasai | 24/170 |
| 5,572,771 | 11/1996 | Kelleghan | 24/170 |

FOREIGN PATENT DOCUMENTS

| | | | |
|---|---|---|---|
| 1537634 | 7/1968 | France | 70/69 |

*Primary Examiner*—Steven N. Meyers
*Assistant Examiner*—Tuyet-Phuong Pham

[57] ABSTRACT

A locking strap includes an elongated strap with a captured end and a free end. A buckle member is fixedly attached to the captured end of the strap. The buckle member is capable of receiving the free end of the strap therethrough to allow looping of the strap around a first object and a second object. Included is a locking mechanism that is secured within a bottom portion of the buckle member. Also, a buckle lid is coupled to the bottom portion of the buckle member and spaced from the locking mechanism. The lid has a first end with a vertical projection for clamping down onto the strap, when the free end is positioned through the buckle. Lastly, a second end of the lid has a pair of flaps for overlapping the bottom portion of the buckle member. The flaps will cause the second end to be locked within the locking mechanism for securing the strap around the first and second object.

1 Claim, 3 Drawing Sheets

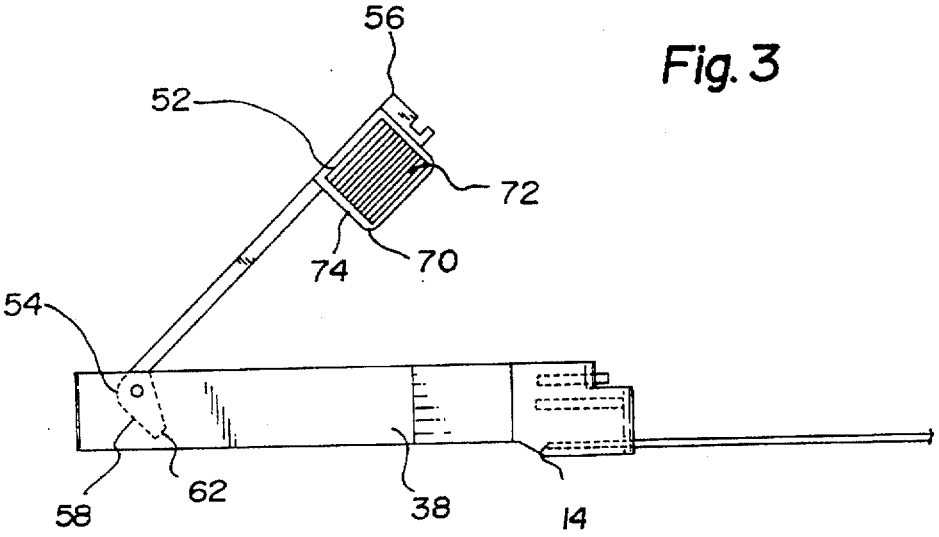
Fig. 3
Fig. 4
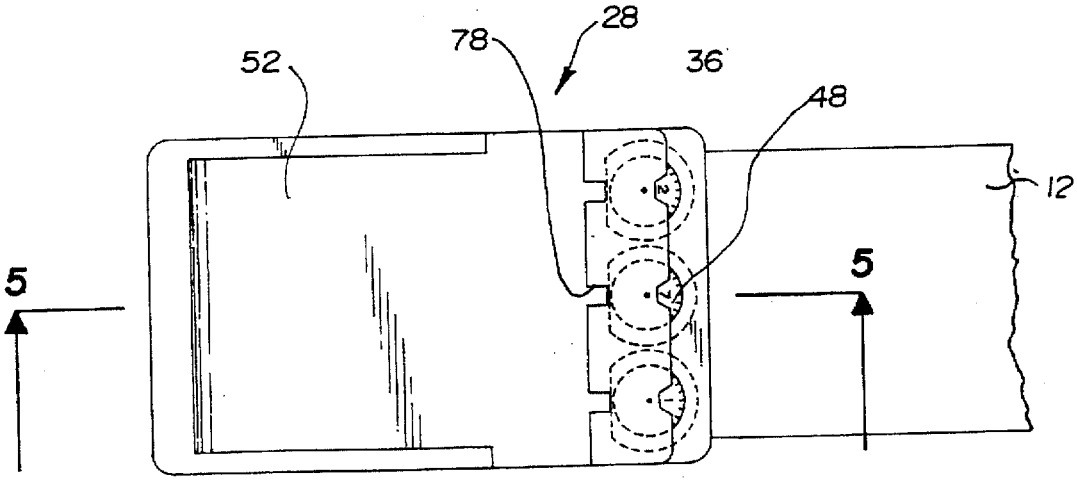

LOCKING STRAP

BACKGROUND OF THE INVENTION

1. Field of the Invention

The present invention relates to a Locking strap and more particularly pertains to providing an anti-theft securement strap for sporting equipment, and may further be worn as a belt when using the sporting equipment.

2. Description of the Prior Art

The use of a lockable strap is known in the prior art. More specifically, lockable straps heretofore devised and utilized for the purpose of locking equipment are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,177,986 to Jensen discloses a lockable tie strap. U.S. Pat. No. 4,715,839 to Ford and Baronoff discloses a novelty belt. U.S. Pat. No. 4,920,772 to Denison discloses a bicycle lock. U.S. Pat. No. 4,135,374 to Goral discloses a bicycle lock. U.S. Pat. Des. No. 322,160 to Dauterive discloses a belt. Lastly, U.S. Pat. Des. No. 255,397 to Button discloses a belt.

While these devices fulfill their respective, particular objectives and requirements, the aforementioned patents do not describe locking strap that allows the user to wear the strap as a belt while involved in the sporting activity and to use the strap to lock up the sporting equipment during breaks from the sporting activity.

In this respect, the locking strap according to the present invention substantially departs from the conventional concepts and designs of the prior art, and in doing so provides an apparatus primarily developed for the purpose of providing an anti-theft securement strap for sporting equipment, and may further be worn as a belt when using the sporting equipment.

Therefore, it can be appreciated that there exists a continuing need for a new and improved locking strap which can be used for providing an anti-theft securement strap for sporting equipment, and may further be worn as a belt when using the sporting equipment. In this regard, the present invention substantially fulfills this need.

SUMMARY OF THE INVENTION

In view of the foregoing disadvantages inherent in the known types of lockable straps now present in the prior art, the present invention provides an improved locking strap. As such, the general purpose of the present invention, which will be described subsequently in greater detail, is to provide a new and improved locking strap and method which has all the advantages of the prior art and none of the disadvantages.

To attain this, the present invention essentially comprises an elongated strap. The strap has a captured end and a free end. The strap is a layer of woven metal that is covered by a layer of polymeric material. A buckle member is fixedly attached to the captured end of the strap. The buckle member can receive the free end of the strap therethrough to allow looping of the strap around a first object and a second object. Also, a locking mechanism is secured within a bottom portion of the buckle. The locking mechanism has at least three tumblers. Each is secured within the buckle member by a cylindrical pin. A buckle lid is coupled to the bottom portion of the buckle member and spaced from the locking mechanism. The lid has a first end and a second end. The first end of the lid has a vertical projection. The vertical projection has a flat face that clamps down onto the strap when the free end is positioned through the buckle member. Lastly, the second end of the lid has a pair of flaps for overlapping the bottom portion of the buckle member. Each flap has a plurality of ridges on an exterior surface thereof for non-slip gripping of the lid, when opening and closing the buckle member. The second end of the lid further has grooves for snap fastening with the tumblers. The second end of the lid is locked within the bottom portion by the tumblers to prevent the release of the free end when the strap is secured around the first and second object.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved locking strap which has all of the advantages of the prior art lockable straps and none of the disadvantages.

It is another object of the present invention to provide a new and improved locking strap which may be easily and efficiently manufactured and marketed.

It is further object of the present invention to provide a new and improved locking strap which is of durable and reliable constructions.

An even further object of the present invention is to provide a new and improved locking strap which is susceptible of a low cost of manufacture with regard to both materials and labor, and which accordingly is then susceptible of low prices of sale to the consuming public, thereby making such Locking strap economically available to the buying public.

Still yet another object of the present invention is to provide a new and improved locking strap which provides in the apparatuses and methods of the prior art some of the advantages thereof, while simultaneously overcoming some of the disadvantages normally associated therewith.

Even still another object of the present invention is to provide a locking strap for providing an anti-theft securement strap for sporting equipment, and may further be worn as a belt when using the sporting equipment.

Lastly, it is an object of the present invention to provide a new and improved locking strap including an elongated strap with a captured end and a free end. A buckle member is fixedly attached to the captured end of the strap. The buckle member is capable of receiving the free end of the strap therethrough to allow looping of the strap around a first object and a second object. Included is a locking mechanism that is secured within a bottom portion of the buckle member. Also, a buckle lid is coupled to the bottom portion of the buckle member and spaced from the locking mechanism. The lid has a first end with a vertical projection for clamping down onto the strap, when the free end is positioned through the buckle. Lastly, a second end of the lid has a pair of flaps for overlapping the bottom portion of the buckle member. The flaps will cause the second end to be locked within the locking mechanism for securing the strap around the first and second object.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view of the buckle member of the present invention.

FIG. 4 is top plan view of the buckle member of the present invention.

The same reference numerals refer to the same parts through the various Figures.

DESCRIPTION OF THE PREFERRED EMBODIMENT

Figure 1:
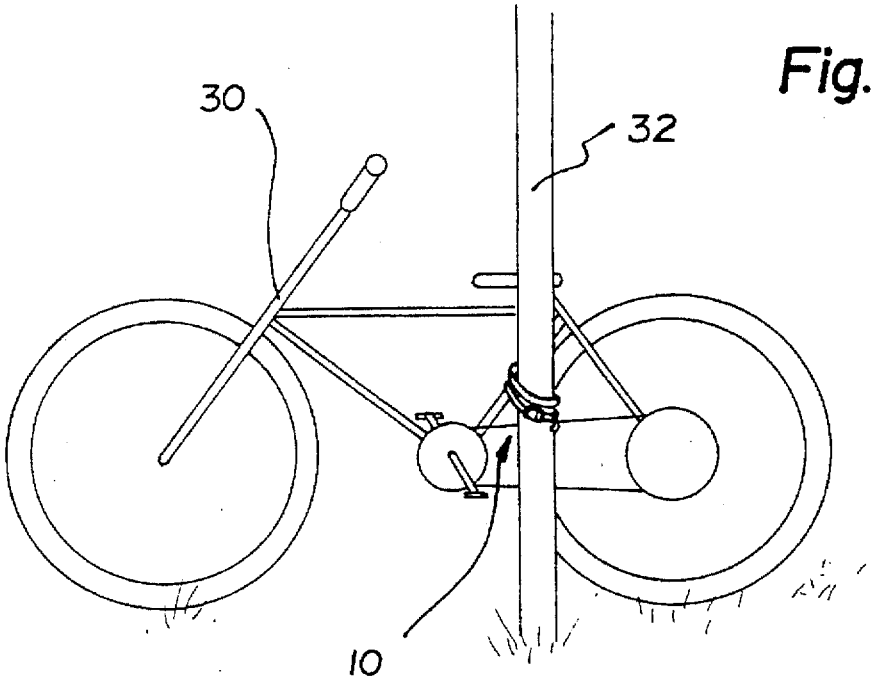
FIG. 1 is a perspective view of the preferred embodiment of the locking strap constructed in accordance with the principles of the present invention.

With reference now to the drawings, and in particular to FIG. 1 thereof, the preferred embodiment of the new and improved locking strap embodying the principles and concepts of the present invention and generally designated by the reference numeral 10 will be described.

The present invention, the Locking strap 10 is comprised of a plurality of components. Such components in their broadest context include a strap and a buckle. Such components are individually configured and correlated with respect to each other so as to attain the desired objective.

Specifically, the present invention includes an elongated strap 12. The strap has a captured end 14 and a free end 16. The strap is formed of an inner layer 20 of woven metal that is covered by an outer layer 22 of polymeric material. Preferably, the woven metal is steel. The polymeric material is nylon. The nylon layer may be any color or combination of colors.

Figure 2:
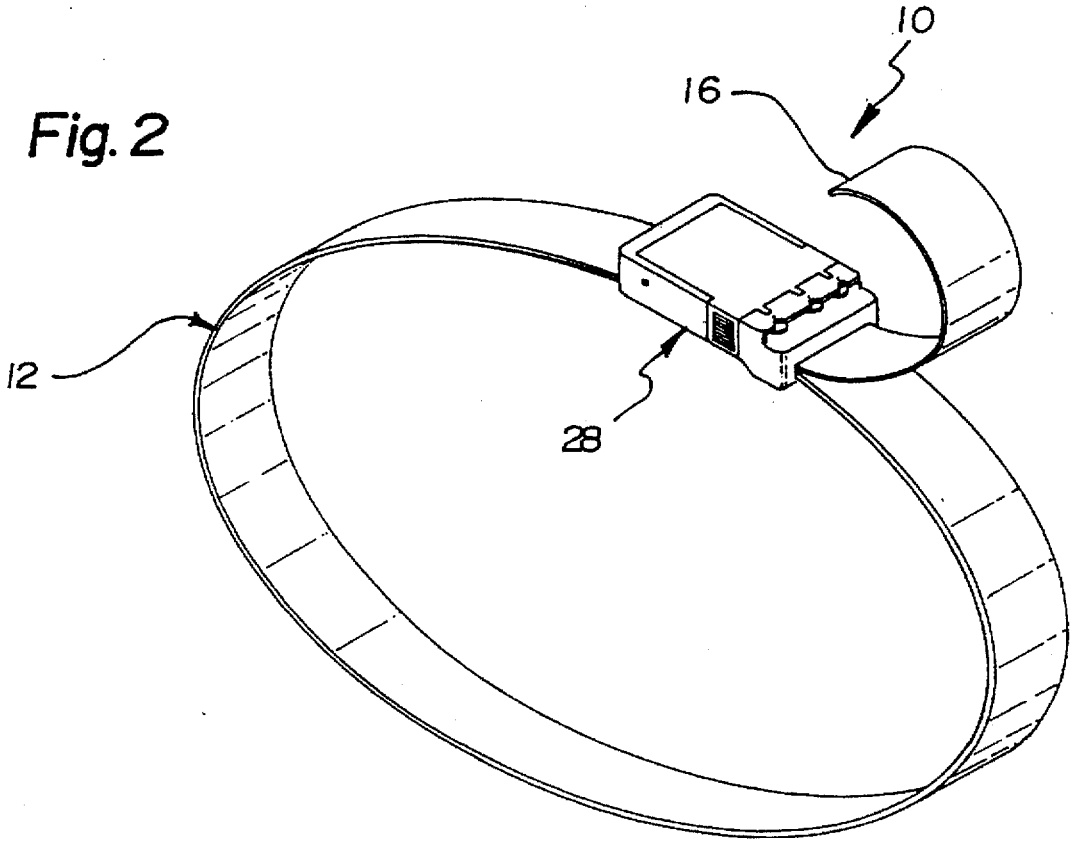
FIG. 2 is an isometric view of the locking of the present invention.

Also, a buckle member 28 is fixedly attached to the captured end of the strap. The buckle member is formed of a rigid material. The buckle member receives the free end 16 of the strap therethrough as shown in FIG. 2. Placing the free end through the buckle member allows looping of the strap around a first object 30 and a second object 32, as seen in FIG. 1.

Additionally, a locking mechanism 36 is secured within a bottom portion 38 of the buckle member 28. The locking mechanism has at least three tumblers 42. Each tumbler is secured within the buckle member by a cylindrical pin 44. The tumblers are disc-like and each tumbler has numbering 48. A combination of numbers are used to unlock the buckle when the buckle member is closed.

Figure 5:
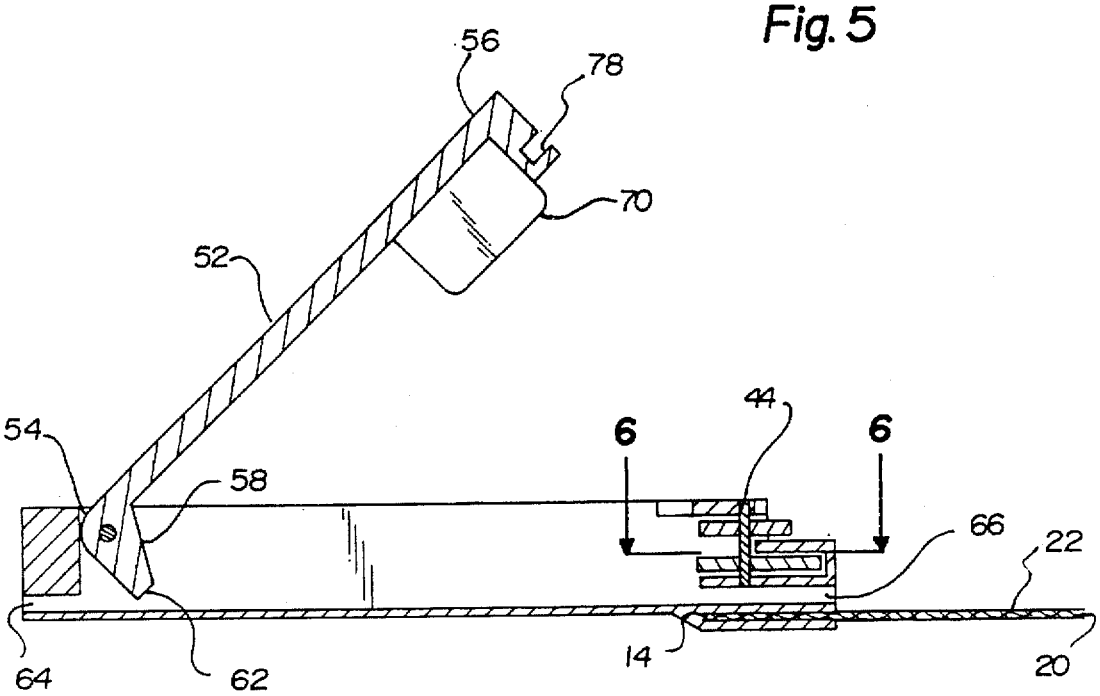
FIG. 5 is a cross-sectional view of the present invention taken along line 5—5 of FIG. 4.
Figure 6:
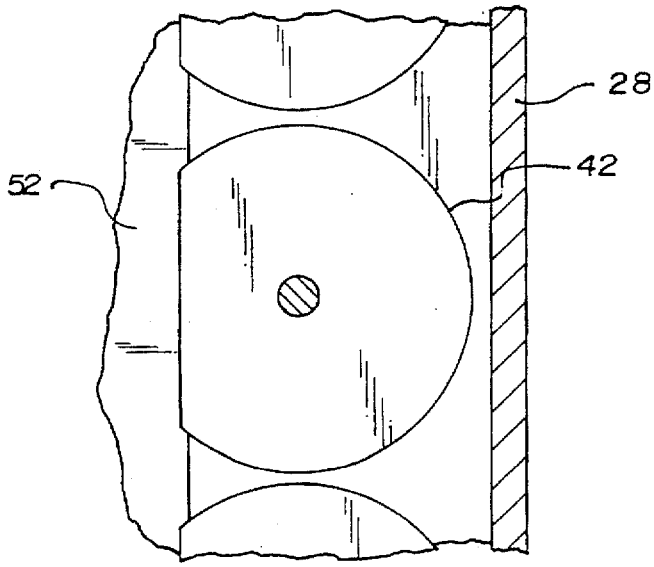
FIG. 6 is fragmentary cut-away view of the present invention taken along line 6—6 of FIG. 5.

As best illustrated in FIG. 5, a buckle lid 52 is included. The buckle lid is coupled to the bottom portion 38 of the buckle member and spaced from the locking mechanism 36. The lid is formed of the same material used to make the buckle member. The lid has a first end 54 and a second end 56. The first end of the lid has a vertical projection 58. The projection extends down and away from the lid. The vertical projection has a flat face 62 capable of clamping down onto the strap 12 when the free end is positioned through the buckle member. The buckle member has a rear opening 64 and a front opening 66 for receipt of the free end of the strap.

Lastly, the second end 56 of the lid has a pair of flaps 70. FIG. 3 shows one of the flaps. Each flap is identical to the other flap. Each flap overlaps the bottom portion of the buckle member. Each flap has a plurality of ridges 72 on an exterior surface 74 for non-slip gripping of the lid when opening and closing the buckle member. The second end of the lid further has grooves 78, as seen in FIG. 4. The grooves allow snap fastening with the tumblers 42. The second end of the lid is locked within the bottom portion by the tumblers to prevent the release of the free end when the strap is secured around the first and second object.

The present invention in a locking strap that provides sporting enthusiasts a convenient, easy-to-carry device for securing their bicycle, snowboard, skis, or other equipment away from thieves. The strap is a steel woven wire wrapped with a nylon material. The strap has a captured end secured within a buckle. The strap may be worn comfortably as a belt while enjoying the sport. When the time comes to take a break or put the equipment away, the strap is right at hand to lockup the equipment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved locking strap for securing recreational items when not in use comprising in combination:

an elongated strap having a captured end and a free end, the strap being a layer of woven metal being covered by a layer of polymeric material being nylon, the strap being sized for wearing as a belt;

a buckle member being fixedly attached to the captured end of the strap, the buckle member being formed of a rigid material, the buckle member having a rear opening and a front opening, the rear opening and the front opening being capable of receiving the free end of the strap therethrough for allowing the looping of the strap around a first object and a second object;

a locking mechanism being secured within a bottom portion of the buckle member, the locking mechanism having at least three tumblers with each secured within the buckle member by a cylindrical pin;

a buckle lid being coupled to the bottom portion of the buckle member and spaced from the locking mechanism, the lid having a first end and a second end, the first end of the lid having a vertical projection extending therefrom, the vertical projection having a flat face capable of clamping down onto the strap when the free end being positioned through the buckle member; and the second end of the lid having a pair of flaps for overlapping the bottom portion of the buckle member, each flap having a plurality of ridges on an exterior surface thereof for non-slip gripping of the lid when opening and closing the buckle member, the second end of the lid further having grooves for snap fastening with the tumblers, the second end of the lid being locked within the bottom portion by the tumblers for preventing the release of the free end when the strap being secured around the first and second object, each tumbler of the buckle member being disc-like and having a numbering wherein a combination of numbers being used for releasing the second end of the lid having been secured to the bottom portion of the buckle member.

* * * * *